US007070514B1

(12) United States Patent
Borunda

(10) Patent No.: US 7,070,514 B1
(45) Date of Patent: Jul. 4, 2006

(54) GOLF CLUB HEAD HAVING INTERNAL IMPACT ASSEMBLY

(76) Inventor: William C. Borunda, 8509 Chicakee La., Clovis, CA (US) 93611

( * ) Notice: Subject to any disclaimer, the term of this patent is extended or adjusted under 35 U.S.C. 154(b) by 0 days.

(21) Appl. No.: 11/206,709

(22) Filed: Aug. 17, 2005

Related U.S. Application Data

(60) Provisional application No. 60/668,913, filed on Apr. 5, 2005.

(51) Int. Cl.
*A63B 53/04* (2006.01)
*A63B 53/06* (2006.01)
*A63B 69/36* (2006.01)

(52) U.S. Cl. ..... 473/333; 473/234

(58) Field of Classification Search ..... 473/231, 473/233, 234, 256
See application file for complete search history.

(56) References Cited

U.S. PATENT DOCUMENTS

| | | | | |
|---|---|---|---|---|
| 690,940 | A | 1/1902 | Febiger | |
| 2,098,445 | A * | 11/1937 | Wettlaufer | 473/333 |
| 2,592,013 | A | 4/1952 | Curley | |
| 3,172,668 | A * | 3/1965 | Blake | 473/234 |
| 3,951,413 | A | 4/1976 | Bilyeu | |
| 5,046,740 | A | 9/1991 | D'Eath | |
| 5,366,222 | A | 11/1994 | Lee | |
| 5,613,916 | A | 3/1997 | Sommer | |
| 5,776,009 | A | 7/1998 | McAtee | |
| 5,911,637 | A * | 6/1999 | Yamagata | 473/333 |
| 6,171,204 | B1 | 1/2001 | Starry | |
| 6,641,490 | B1 | 11/2003 | Ellemor | |

FOREIGN PATENT DOCUMENTS

| | | | |
|---|---|---|---|
| JP | 03222974 | A * | 10/1991 |
| JP | 05269224 | A * | 10/1993 |
| JP | 08150230 | A * | 6/1996 |
| JP | 2001309998 | A * | 11/2001 |

* cited by examiner

*Primary Examiner*—Eugene Kim
*Assistant Examiner*—Alvin A. Hunter, Jr.
(74) *Attorney, Agent, or Firm*—Richard A. Ryan

(57) ABSTRACT

An improved golf club head having an internal impact assembly configured to improve the direction and distance of travel of a golf ball. The impact assembly is configured to impact the inside wall of the club face at an impact spot immediately after the golf ball is hit to provide a kick to the golf ball so as to direct it along the desired direction of travel. The impact assembly is in a club head cavity and comprises a support member attached to the cavity, a spaced apart hammer member and a connecting member interconnecting the support member and hammer member. In a preferred embodiment, the connecting member is fixed to the support member and configured, such as being made out of graphite or the like, to flex the hammer member into the impact spot. In an alternative embodiment the connecting member is pivotally connected to the support member.

5 Claims, 9 Drawing Sheets

GOLF CLUB HEAD HAVING INTERNAL IMPACT ASSEMBLY

CROSS-REFERENCE TO RELATED APPLICATIONS

This application claims the benefit of U.S. Provisional Application No. 60/668,913 filed Apr. 5, 2005.

BACKGROUND OF THE INVENTION

A. Field of the Invention

The field of the present invention relates generally to apparatuses and devices utilized in the game of golf. More specifically, this invention relates to golf club heads that have an internal or built-in impact assembly which is configured to automatically assist the golfer in driving the golf ball straighter and further. Even more specifically, this invention relates to such golf club heads that utilize a fixed or pivoting hammer-like mechanism inside the club head or a ball or ball-like object in an internal tube or channel inside the club head.

B. Background

Golf is one of the most popular sports in the United States and throughout the world. Due to various factors, including its outdoor and group participatory nature, golf is played by a number of professionals, including some highly successful and high profile professionals, and millions of amateurs. To enjoy and do well at golf, however, a golfer has to master a number of different variables with regard to his or her golf swing so that the head of the golf club will strike the golf ball in a manner that drives the golf ball in the desired direction and distance. With regard to the swing of the golf club, the placement of the golfer's feet relative to the ball, the grip on the handle of the club and the motion of his or her upper body, particularly the shoulders and elbows, all affect the quality of the swing and, ultimately, the striking of the golf ball. The general goal of a good swing is to strike the golf ball with the face of the club at a point in the swing where the golf club head velocity is the greatest and in a manner such that the plane of the golf club face is generally perpendicular with the desired direction of travel. To obtain the greatest distance and a straight ball flight, the area of the center of gravity of the golf club head should strike the golf ball. The portion of the golf club face which corresponds to the center of gravity of the golf club head and where it is desired to strike the golf ball is commonly known as the "sweet spot" of the club face. Typically, this is located at the center of the club head face directly forward of the head's center of gravity. Failure to hit the golf ball exactly at this sweet spot is very likely to result in errant or misdirected travel for the ball (i.e., slicing or hooking of the ball). Generally, the further away from the sweet spot that the golf ball is struck, the more misdirected it will be.

Hitting the golf club at the sweet spot of the golf club face is not an easy task to master. The various factors that effect the golfer's swing results in inconsistencies in the contact between the club head and the golf ball that causes the club face to strike the golf ball at least slightly away from the sweet spot. As those who play the game of golf can readily attest, it is difficult to always swing the golf club in a manner that results in the golf ball being struck at the sweet spot of the club's face. Despite years of lessons and other training and playing the game of golf, most players never fully master the ability to strike the golf ball at exactly the desired location on the golf club face. Even professionals who are considered masters of the game of golf have at least occasional trouble with the golf ball traveling on an errant and generally undesirable path.

As is well known, golf is a game where the lower a golfer's score, which is measured by the number of strokes he or she needs to complete the particular hole or course, the better. Golf balls that fly an errant or misdirected fligh path require the golfer to take additional stokes to get back on course to the desired cup, which increases the golfer's score. For those who play competitively or otherwise are concerned about their score, whether professionals or not, these additional strokes and increased score due to poor golf ball flight can be somewhat frustrating and disheartening. To improve the striking of the golf club head against the golf ball, and ultimately reduce the golfer's strokes, a great number of devices and methods have been developed over the years. Some of these improvements to the game of golf are in the nature of improved golf club heads, including those having an inertia adjusting or force providing mechanism to attempt to correct or improve the flight of the golf ball. A number of these improvements are the subject of issued patents. For instance, U.S. Pat. No. 690,940 to Febiger discloses a golf club head having one or more slots in the head that each have a freely moveable weight disposed therein for striking the back side of the club face when the club strikes a golf ball. U.S. Pat. No. 2,592,013 to Curley discloses a golf club head having one or more tubes therein that each have a permanent magnet at one end and a moveable projectile that is configured to cooperate with the magnet and strike the back side of the face of the club when the club strikes a golf ball. U.S. Pat. No. 3,951,413 to Bilyeu discloses a golf club head having a moveable center of gravity resulting from the movement of mercury or a spring-loaded ball within an arc-shaped passageway inside the club head. U.S. Pat. No. 5,046,740 to D'Eath describes a putter having longitudinal bore inside the club head that has a series of abutting balls in the bore. U.S. Pat. No. 5,366,222 to Lee discloses a golf club head having a weight distributing system comprised of a moveable, golf ball-sized steel ball and a permanent magnet inside a cavity in the club head to improve directional movement of the golf ball. U.S. Pat. No. 5,613,916 to Sommer and U.S. Pat. No. 5,776,009 to McAtee describe golf club heads having an internal chamber with small, generally spherical members, such as shot, inside the chamber to reduce the shock or impact forces or to provide additional force to the hit golf ball. U.S. Pat. No. 6,171,204 to Starry discloses a golf club head having a rectangular-shaped cavity with a like configured block disposed therein and biased toward the back of the cavity by a spring or a magnet. A tension adjusting mechanism allows the user to adjust the amount of tension on the spring. U.S. Pat. No. 6,641,490 to Ellemor discloses a golf club head having a u-shaped tube with mercury therein to shift the center of gravity as necessary to improve the golf ball direction and distance. In a number of the above patents, use of the weight adjusting mechanism is to affect the center of gravity of the club head so as to affect the impact against a golf ball that is not hit at the sweet spot on the club face.

Overall, despite the prevalence of the problem, these various improvements have not been well accepted and are generally not incorporated into present golf club heads. With regard to professional golfers, the relevant rules require that no part of the golf club, comprising the club head and shaft, should be designed to move or incorporate any moving parts, including powder, pellets, liquid, rollers or tuning forks. Although the shaft of the club may bend by three or four inches during the swing, it is not considered a moving part. What is needed, therefore, is a golf club head that improves the flight direction and distance of a golf ball regardless of whether the golfer strikes the golf ball exactly at the desired sweet spot. An improved golf club head will provide a mechanism for effectively correcting the golfer's strike against the golf ball such that the golf ball will travel in a generally desired straight direction. The desired improved golf club head will correct the common problems of slicing and/or hooking of the golf ball and will provide greater traveling distance for the golf ball along the desired direction of travel.

SUMMARY OF THE INVENTION

The improved golf club head of the present invention provides the benefits and solves the problems identified above. That is to say, the present invention discloses a golf club head that substantially improves the direction of travel and distance of a golf ball that is hit by the club head when the golfer fails to hit the ball exactly at the club head's sweet spot. The preferred embodiments of the improved golf club head of the present invention utilizes an internal impact assembly to effectively correct a golfer's swing by countering the effect of not hitting the golf ball at the club head's sweet spot, thereby improving both the direction and amount of travel of the hit golf ball. The internal impact assembly of the preferred embodiments automatically effect the contact by the club face against the golf ball so as to counter not hitting the ball exactly at the club head's sweet spot by impacting the back of the club face at a spot offset from the sweet spot. As such, the improved golf club head of the present invention will allow the golfer to better hit the golf ball so as to cause it to travel in the direction desired by the golfer, as opposed to slicing and/or hooking the golf ball.

In one general aspect of the present invention, the improved golf club head comprises an impact assembly disposed inside the club head cavity that is configured to deliver an impact to the wall of the cavity behind the club face at an impact spot so as to provide a slight kick or blow to the golf ball immediately after it is hit by the golf club head to better direct the hit golf ball along the desired direction of travel. In a preferred embodiment, the impact assembly comprises a support member that is attached to one or more of the walls of the cavity, a spaced apart hammer member configured to impact the impact spot and a connecting member interconnecting the support member and the hammer member. Preferably, the connecting member is fixed to the support member so the impact assembly does not constitute a moving component in violation of the relevant golf rules and regulations. In this embodiment, the connecting member is configured to flex and then direct the hammer member into the impact spot in response to the change in momentum resulting from the impact of the club face against the golf ball. Like the club shaft, which although it flexes during the golfer's swing is considered a non-moving part, the flexing of the impact assembly is also a non-moving part. The connecting member can be shaped and configured to achieve the desired flexing. In one embodiment, the connecting member is an elongated shaft. The connecting member can be made out of a material that provides the desired, relatively small amount, of flexing, such as graphite or similar materials. As the club head is swung in the downward direction, the connecting member will allow the hammer member to flex toward the back of the club head. When the club face hits the golf ball, the flexing nature of the connecting member will allow the inertia force of the hammer to be driven against the inside wall of the club face at the impact spot to deliver the desired kick to the golf ball. In an alternative embodiment, the connecting member is pivotally attached to the support member to pivot the hammer member into the back wall of the club face. Various pivoting mechanisms can be utilized to connect the connecting member to the support member. In one embodiment, the connecting member pivots around a pivot shaft component of the support member and the hammer member has a curvilinear shape generally matching the direction of travel of the hammer member during its pivoting travel. In another alternative embodiment, the impact assembly comprises a tube or channel disposed in the golf club head and a ball that rolls in the tube or channel to contact the back wall of the club face. A spring can be positioned at the back end of the tube or channel to improve the action of the ball during the upswing portion of the golf stroke.

Accordingly, the primary objective of the present invention is to provide an improved golf club head that provides the advantages discussed above and overcomes the disadvantages and limitations which are associated with presently available golf club heads.

An important objective of the present invention is to provide an improved golf club head that is configured to improve the travel path and distance of a golf ball struck thereby.

It is also an important objective of the present invention to provide an improved golf club head that has an internal or built-in impact or force providing mechanism which is configured to automatically assist the golfer in driving the golf ball straighter and further.

It is also an important objective of the present invention to provide an improved golf club head that has an internal or built-in impact or force providing mechanism which is configured to automatically counteract the failure of the golfer to hit a golf ball exactly at the golf club head's sweet spot.

It is also an important objective of the present invention to provide an improved golf club head that utilizes a fixed or pivoting hammer-like mechanism which is configured to swing against the back side of the club face so as to improve the likelihood that a golf ball struck by the club head will travel in the desired direction of travel.

It is also an important objective of the present invention to provide an improved golf club head that utilizes a ball or ball-like object which is moveably disposed in an internal tube or channel that is configured to impact against the back side of the club face so as to improve the likelihood that a golf ball struck by the club head will travel in the desired direction of travel.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the improved golf club head of the present invention, the preferred embodiments of the present invention are set forth below. As will be recognized by those skilled in the art, the enclosed figures and drawings are merely illustrative of the preferred embodiments and represent several different ways of configuring the present invention. Although specific components, materials, configurations and uses are illustrated, it should be understood that a number of variations to the components and to the configuration of those components described herein and in the accompanying figures can be made without changing the scope and function of the invention set forth herein.

Figure 1:
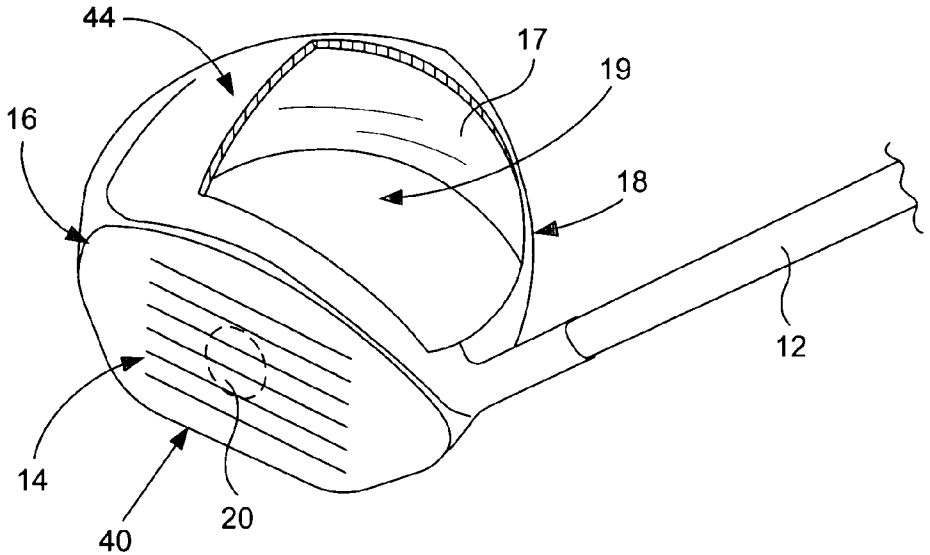
FIG. 1 (PRIOR ART)
FIG. 1 is a perspective view of a prior art golf club head showing the cavity inside the golf club head.

An improved golf club head that is manufactured out of the materials and configured pursuant to the principles of the present invention is shown generally as 10 in the figures. As shown in FIG. 1, and as is well known in the art, golf club head 10 is fixedly attached to a golf club handle or shaft 12. Golf club head 10 has a club face 14 at a first end 16 thereof that is spaced apart from second end 18. As is known in the art, the typical driver type of golf club has a head 10 that is generally hollow, having a plurality of interior walls 17 defining a cavity 19 therein. The golf club head's sweet spot, shown as 20, is known to be positioned somewhere on the club face 14 and is the desired location where club face 14 contacts a golf ball that is struck by golf club head 10. While sweet spot 20 is generally located at the center of the club face 14, the exact location of sweet spot 20 is that position on the club face 14 that is directly forward of the center of gravity of golf club head 10. A strong solid hit of golf club 10 against a golf ball will generally encompass the entire sweet spot 14 area. It is at this location that, theoretically, a golf ball will travel the furthest and straightest. As set fort above, however, it is often difficult for the golfer to exactly contact the club face 14 against the golf ball at the sweet spot 14. As a result, the ball often travels in a slicing direction (i.e., generally curving away to the right) or a hooking direction (i.e., generally curving inward to the left), that is not desired by the golfer. In addition to the misdirected travel, the golf ball will generally not travel as far when it is hit in this manner.

As is also well known, the golfer initiates his or her golf swing with a back swing that brings the club head 10 over the golfer's shoulder or back area. During the downward or forward swing, the club shaft 12 will tend to flex, up to as much as three to four inches depending on the material used for club shaft 12, as the golfer swings club head 10 downward so face 14 of club head 10 strikes the golf ball. Upon impact, the golf ball flattens against the face 12 of club head 10 until the inertia force of the club head 10 is transferred to the golf ball to cause it to leave the club head 10 and regain its generally round form. The amount of time between the initial impact of the club face 14 against the golf ball and the time it leaves the club head 10 is generally measured in the ten-thousandths of a second. Maximum impact force is transferred to the golf ball without the club head 10 torquing when the club face 14 hits the golf ball at the sweet spot 20. Failure to hit the golf ball at the sweet spot will tend to misdirect the golf ball and/or impart the golf ball with an undesirable side spin.

Figure 4:
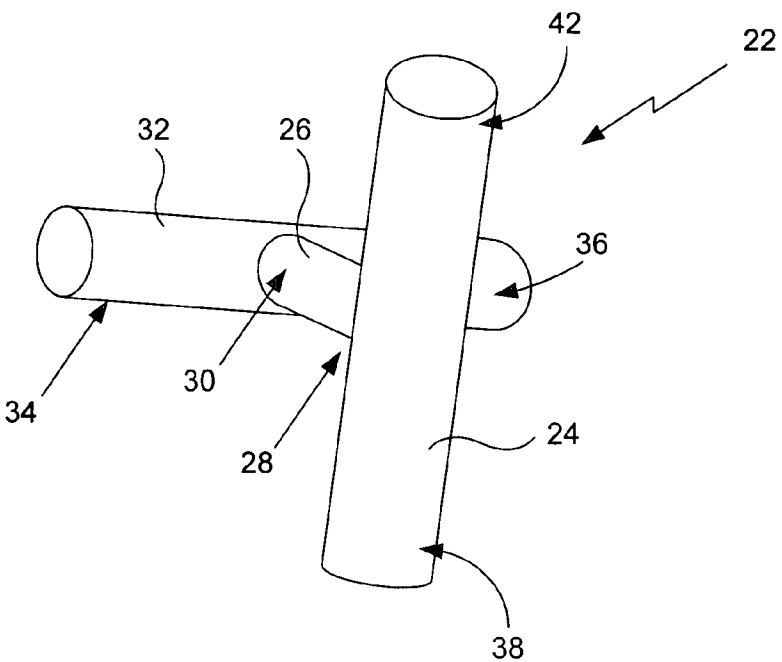
FIG. 4 is a perspective view of the internal impact assembly of FIGS. 2 and 3.
Figure 2:
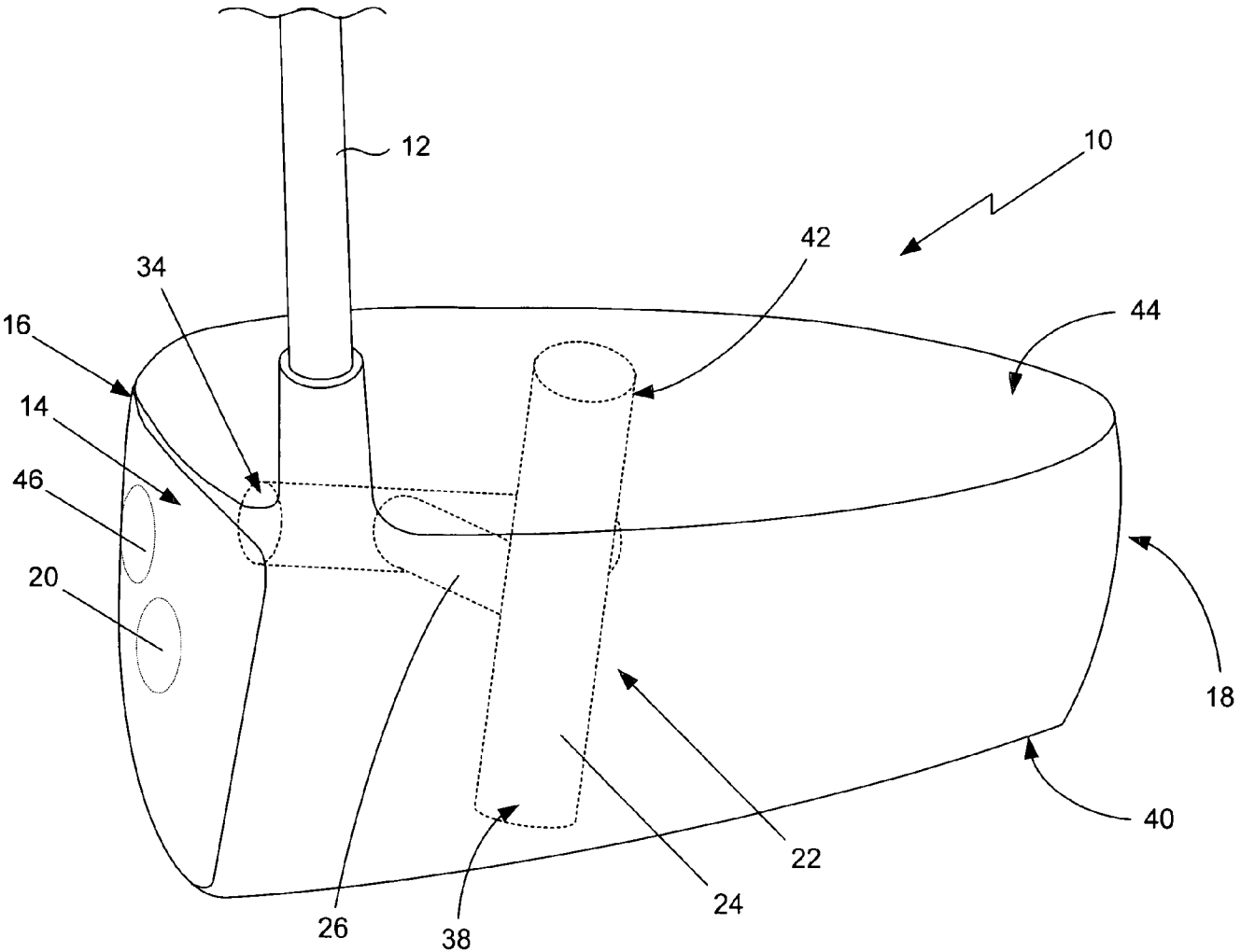
FIG. 2 is a side view of an improved golf club head configured according to the attributes of a preferred embodiment of the present invention having an internal impact assembly comprising a fixedly attached hammer or hammer-like device disposed inside the club head that is configured to flex and strike the backside of the club face.
Figure 3:
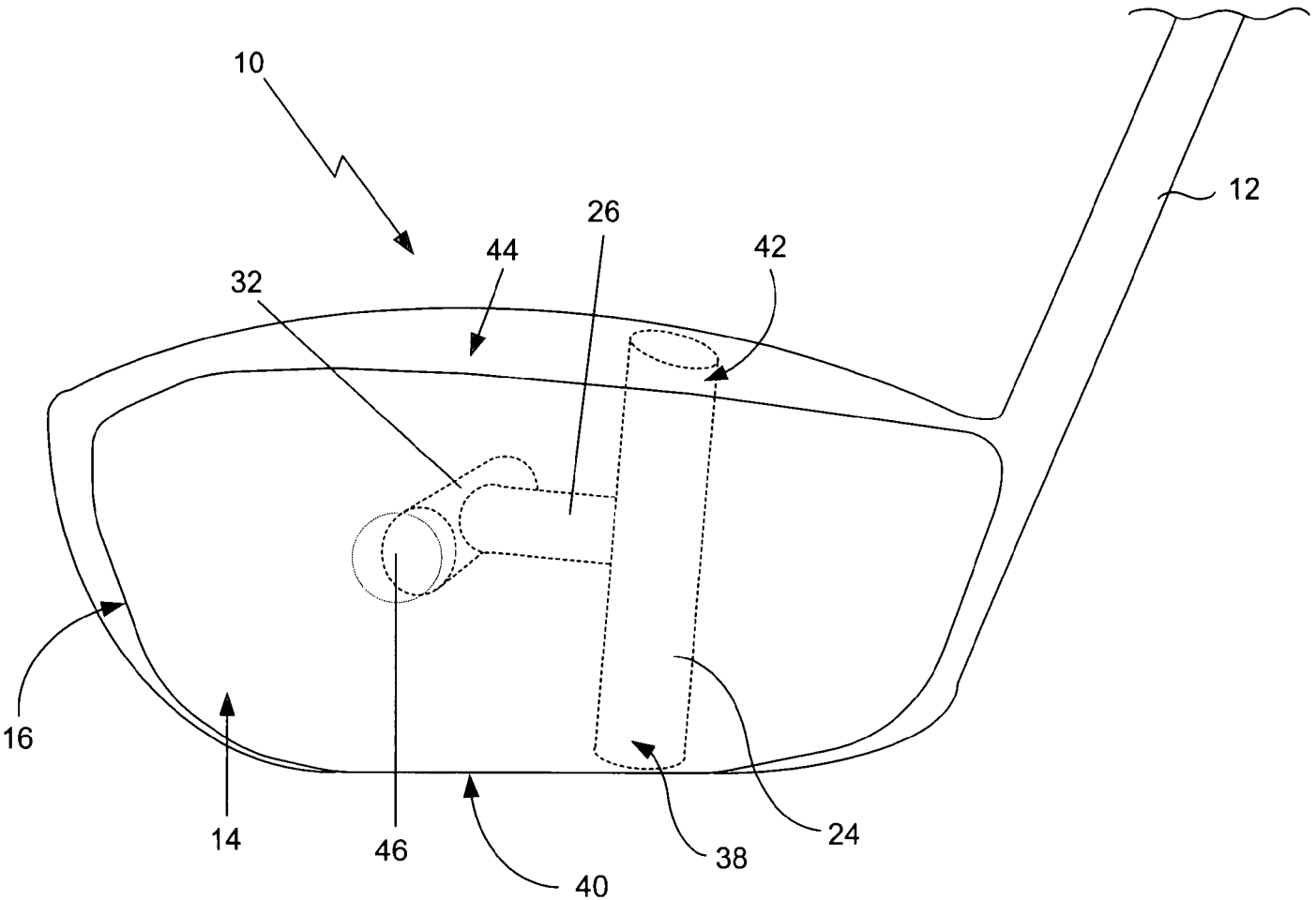
FIG. 3 is a club head front or face view of the improved golf club head of FIG. 2.

To improve the likelihood that a golf ball struck by club face 14 will travel in a generally straight or desired direction of travel for the desired distance even when the golfer fails to hit the golf ball at sweet spot 20, the embodiment of the golf club head 10 of the present invention shown in FIGS. 2 and 3 comprises an internal impact assembly 22 that is fixedly disposed inside cavity 19 of golf club head 10. In this embodiment, impact assembly 22 comprises a support member 24 having a generally outwardly extending connecting member 26 having a first end 28 that is attached to support member 24 and a second end 30 attached to a hammer member 32, which has a first end 34 and a second end 36, as best shown in FIG. 4. In the preferred embodiment, support member 24 has a first end 38 that is fixedly attached to the interior wall 17 at bottom side 40 of club head 10 and a second end 42 fixedly attached to the interior wall 17 at top side 44 of club head 10. In the preferred configuration of this embodiment, connecting member 26 is configured as an elongated shaft that is made out of graphite or some other moderately flexible material and support member 24 and hammer member 32 are made out of steel or some other generally rigid material. As set forth in more detail below, the components of impact assembly 22 are configured such that the first end 34 of hammer member 32 will strike the interior wall 17 at the back side of club face 14 at a position designated as impact spot 46 to effect the direction of travel of the golf ball hit by club head 10. As will be recognized by those skilled in the art, although hammer member 32 is shown as a generally elongated member with first end 34 and second end 36 in the figures, it can be configured in a variety of different ways and still provide the desired impact and weight attributes necessary for the present invention. For instance, hammer member 32 could be configured to be a weighted component at the second end 30 of connecting member 26 or even just the second end 30 of connecting member 26 itself.

In this embodiment, support member 24 is an elongated, generally cylindrically shaped component that has its first end 38 fixedly attached or formed integral with the interior wall 17 at bottom side 40 of club head 10 and its second end 42 fixedly attached or formed integral with the interior wall 17 at top side 44 of club head 10 such that support member 34 is a fixed component generally extending across the cavity 19 inside club head 10. In this manner, support member 34 is a supported post to which the shaft-like connecting member 26 is attached or formed integral therewith. Support member 24 can be made out of a variety of different materials, including metals such as steel or aluminum, plastics, composites and others. In addition, as known by those skilled in the art, support member 24 can be configured in a variety of different shapes and configurations and still accomplish the objectives herein. As shown in FIGS. 2 through 4, connecting member 26 extends outwardly from support member 34 in a generally cantilever configuration. Typically, but not exclusively or necessarily required, connecting member 26 will be in a generally perpendicular relationship with support member 34. For the flexing action described in more detail below, depending on the materials utilized, it may be beneficial to utilize a generally perpendicular configuration. As will be readily apparent to those skilled in the art, the exact relationship between connecting member 26 and support member 34 will depend on how support member 34 is configured relative to impact spot 46, such that connecting member 26 will dispose first end 34 of hammer member 32 at impact spot 46. Any corresponding relationship between support member 24 and connecting member 26 that places first end 34 of hammer member 32 directly behind impact spot 46 such that it impacts impact spot 46 as desired, will be generally acceptable for club head 10. Hammer member 32 is disposed, also in a generally cantilever fashion, at the second end 30 of connecting member 26.

In the preferred embodiment of this configuration, the components of impact assembly 22 are fixed in position inside the cavity 19 of club head 10. As stated above, the shaft-like connecting member 26 is made from a material that flexes to allow hammer member 32 to impact the interior wall 17 at the back side of club face 14. In a preferred embodiment, connecting member 26 is made out of the same graphite material utilized for many golf club shafts 12, or material which is similar in nature, that is known to flex as a result of the force from the golfer's swing. Although graphite is preferred due to its flexing, lightweight and durable properties, which also make it desirable for club shaft 12, connecting member 26 can be made out of other materials, including metals, composites and certain plastics. Alternatively, connecting member 26 can be configured in such a manner, such as having a smaller diameter section or overall smaller diameter depending on the material utilized for connecting member 26, to obtain the same flexing effect as can be obtainable with a material such as graphite.

As stated above, hammer member 32 is configured such that first end 34 thereof will impact the interior wall 17 at the back side of club face 14 at the desired impact spot 46 so as to effect the direction of travel of the golf ball. In the configuration shown in the figures, impact spot 46 is located to the outside of sweet spot 20 so as to reduce or substantially eliminate slicing (i.e., errant ball travel that generally curves away to the right of the desired direction of travel). To obtain other benefits, such as additional force at sweet spot 20 or to prevent or reduce hooking, impact spot 46 would be appropriately located on club face 14 (i.e., at sweet spot 20 or to the inside thereof). Other problems may also be prevented or reduced by the proper placement of impact spot 46. To accomplish the objectives herein, hammer member 32 should have sufficient weight to affect the direction of travel of the golf ball by impact against the inside surface of club face 14. Although hammer member 32 is shown as generally cylindrical in FIGS. 2 through 4, those skilled in the art will readily recognize that numerous configurations for hammer member 32 are adaptable to the invention set forth herein. The necessary weight for hammer member 32 can be provided by the mass of hammer member 32 itself or by the use of a counterweight type of arrangement at the second end 36 of hammer member 32. In one preferred embodiment, hammer member 32 is made out of steel or like materials.

In use, with support member 24 fixed into place inside the cavity 19 of club head 10 or integral therewith and with the first end 28 of connecting member 26 attached or integral with support member 24 and hammer member 32 fixedly attached or integral with the second end 30 of connecting member 26, the golfer will grip club shaft 12 and swing it as he or she normally would to contact club face 14 of club head 10. As the golfer moves through the downstroke, the inertia force will cause connecting member 26 to allow hammer member 32 to flex towards the second end 18 of golf club head 10. When the club face 14 strikes the golf ball and the golf ball responds by flattening out before it becomes separated from club face 14, the inertia force will cause connecting member 26 to flex hammer member 32 such that second end 34 of hammer member 32 will impact against the interior wall 17 at impact spot 46. This impact, occurring in the fraction of a second while the club face 14 is still in contact with the golf ball, will give a slight force to the golf ball to counter any tendency of the golf ball to move in a slice direction. As such, if the golfer has a tendency to cause the golf ball to slice, then the improved golf club head 10 of the present invention will correct that error. The natural flexing motion of connecting member 26 effectively mimics and mirrors the flexing motion of golf club shaft 12 that occurs naturally from the golfer's swing. Because there are no moving parts in golf club head 10, other than the flexing of the shaft-like connecting member 26 which is the same as that of club shaft 12, the improved golf club head 10 of the present invention should not be in conflict with presently established golfing rules regarding no moving parts. Unlike prior art devices that have moving balls, blocks, projectiles, shot or other moving weighted components, golf club head 10 has no independently moving parts. Like the exception to the no moving parts rule for the flexing of the club shaft 12, the flexing of connecting member 26 should not be considered a moving part in violation of that rule. As such, the configuration of golf club head 10 of the present invention should be suitable for professional and tournament play.

In other embodiments of the present invention, shown in FIGS. 5 through 10, impact assembly 22 does move (as explained below, it either pivots or comprises a ball-type mechanism). This should not prevent the use and enjoyment of a golf club having golf club head 10 of the present invention. Much like baseball where non-professional baseball players utilize aluminum bats to obtain improved hitting distance but use of such bats is not allowed in the professional leagues or the use of golf carts is not allowed in professional tournaments, as well as various other aspects of this and other sports, club head 10 of the present invention can be utilized by those who just desire to play the game of golf because they enjoy it for exercise and recreation. In fact, it is well known that the vast majority of people who play golf are not professionals and/or do not play in a professional-type competition and, as a result, can utilize and benefit from the present invention.

Figure 5:
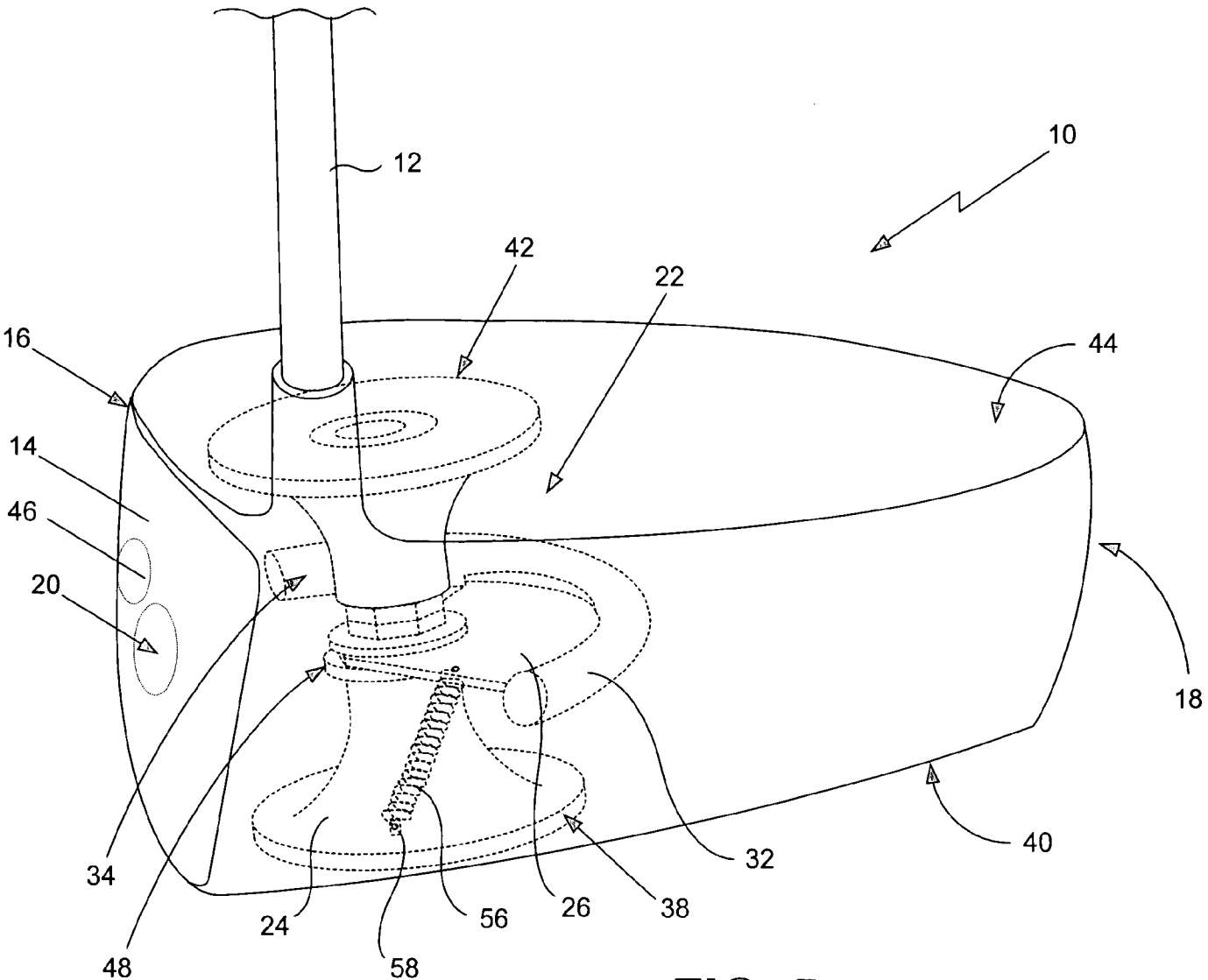
FIG. 5 is a side view of an improved golf club head configured according to the attributes of an alternative embodiment of the present invention having an internal impact assembly comprising a pivotally attached hammer or hammer-like device disposed inside the club head that is configured to swing and strike the backside of the club face.
Figure 6:
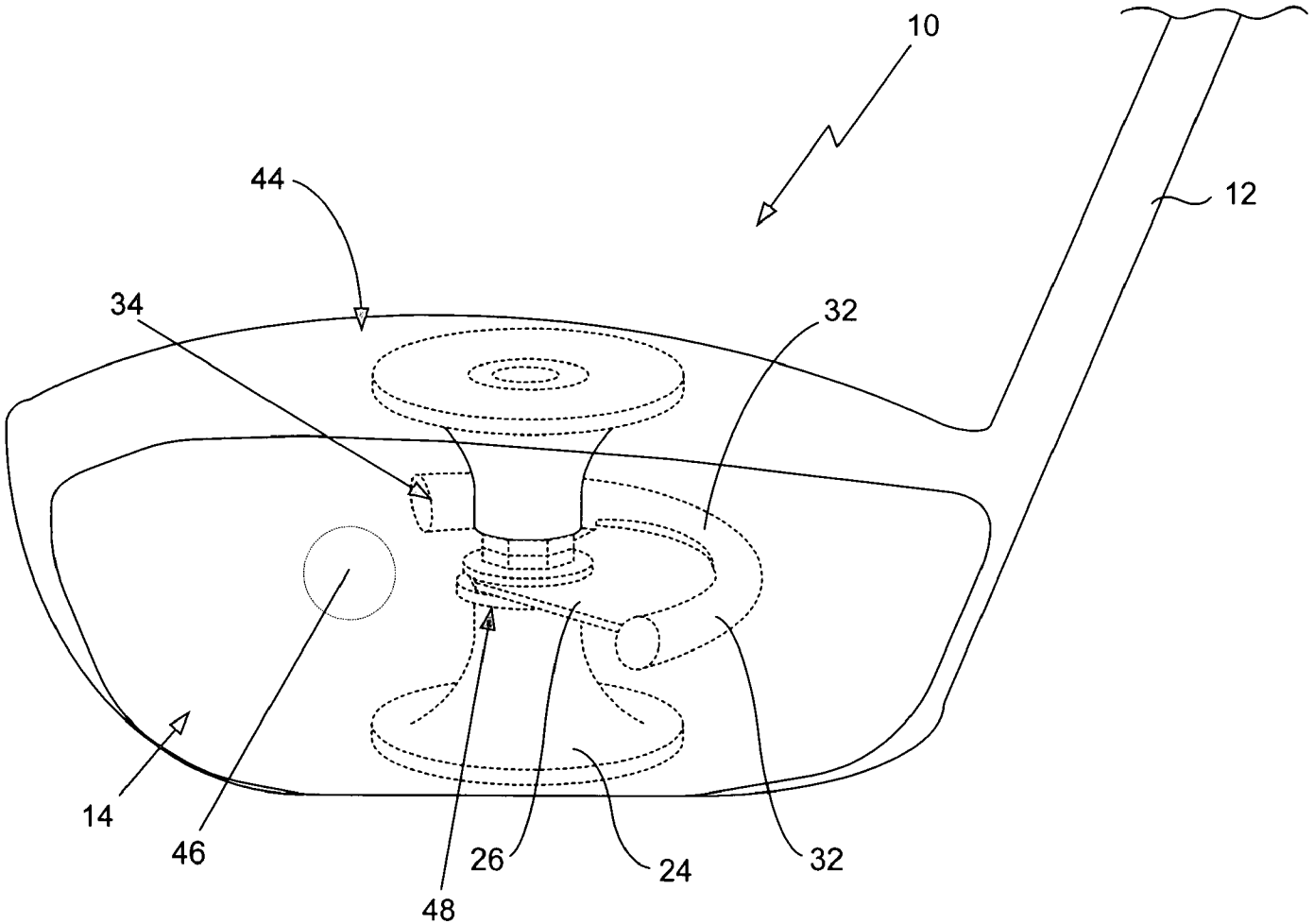
FIG. 6 is a club head front or face view of the improved golf club head of FIG. 5, shown without the spring.
Figure 7:
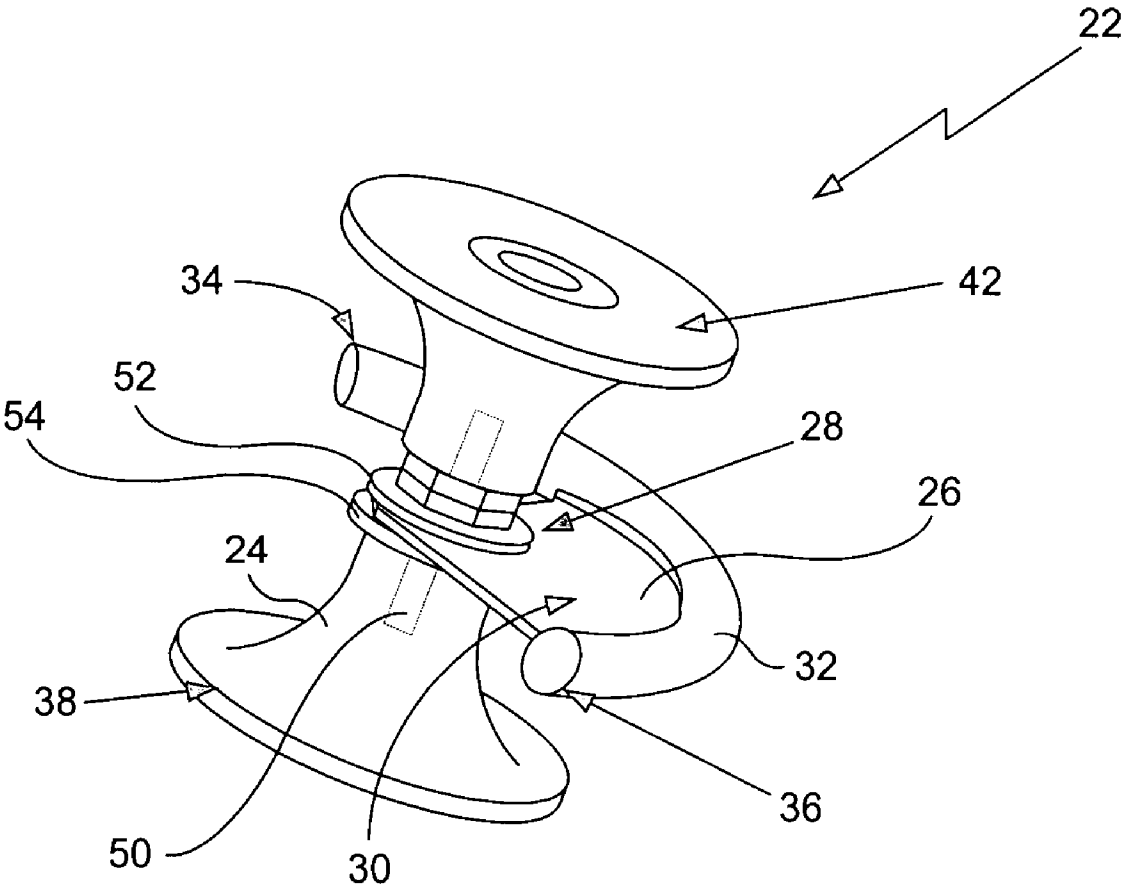
FIG. 7 is a perspective view of the internal impact assembly of FIGS. 5 and 6.

In the embodiment of the golf club head 10 of the present invention shown in FIGS. 5 through 7, impact assembly 22 is configured to pivot or rotate hammer member 32 such that the first end 34 thereof will contact the interior wall 17 at back side of club face 14 at impact spot 46. As with the above-described embodiment, impact assembly 22 has support member 24, connecting member 26 and hammer member 32, as best shown in FIG. 7, and is positioned inside cavity 19 of club head 10. First end 38 of support member 24 fixedly attaches to or is integral with the interior wall 17 at bottom side 40 of club head 10 and second end 43 of support member 24 fixedly attaches to or is integral with the interior wall 17 at top side 44 of club head 10, as best shown in FIGS. 5 and 6. Hammer member 32, which in this embodiment is shaped in a generally curvilinear manner to correspond to its travel path, is fixedly attached to or integral with the second end 30 of connecting member 26 so as to drive first end 34 of hammer member 32 into the back side of club face 14 at impact spot 26. The second end 36 of hammer member 32 is configured to provide additional weight to improve the inertia force of hammer member 32. Unlike the above embodiment, in the embodiment of FIGS. 5 through 7 the first end 28 of connecting member 26 is pivotally attached to support member 24 by use of pivoting mechanism 48.

In one configuration of this embodiment, best shown in FIG. 7, pivoting mechanism 48 comprises a pivot shaft 50, which is received by an aperture (not shown) at first end 28 of connecting member 26 and around which connecting member 26 pivots or rotates, and a pair of pivot plates, first pivot plate 52 and second pivot plate 54, which hold connecting member 26 in place in a manner that allows connecting member 26 to pivot or rotate around pivot shaft 50. The impact assembly 22 of this embodiment operates much the same way as the above embodiment, except pivoting instead of flexing, in that during the down swing the inertia force is gained by the pivoting of second end 36 of hammer member away from impact spot 46 and the impact is delivered to impact spot 46 by the pivot motion of pivoting mechanism 48 to drive first end 34 of hammer member 32 into the interior wall 17 at back side of club face 14 at impact spot 46. As with the above, the impact of first end 34 of hammer member 32 at impact spot 46 is configured to occur during the fraction of a second before the golf ball separates from club face 14 of golf club head 10 so as to correct a golf ball that would otherwise follow an undesirable slice path. Other configurations of impact assembly 22 can be utilized to correct other problems or provide other benefits. As will be readily apparent to those skilled in the art, a number of different configurations can be utilized to obtain the pivoting necessary for second end 34 of hammer member 32 to impact at impact spot 46. In one embodiment, the components of impact assembly 22 are made out of metal, such as steel, aluminum or other metals or out of various other materials, including composites, plastics and the like, alone or in combination with metals.

As shown in FIG. 5, the impact assembly 22 of the above-described embodiment can include a spring 56 to slow the speed of hammer member 32 so that first end 34 thereof does not hit interior wall 17 at back side of club face 14 at impact spot 46 before golf club head 10 strikes the golf ball. Spring 56 should be selected such that the timing of the impact against impact spot 46 is just slightly after the impact of club head 10 against the golf ball. In a preferred embodiment, spring 56 interconnects connecting member 26 and a fixed position inside of golf club head 10, including the interior wall of club head 10. As shown in FIG. 5, spring 56 can interconnect connecting member 26 with a support member 24, through the use of pin 58 or other mechanism.

Figure 8:
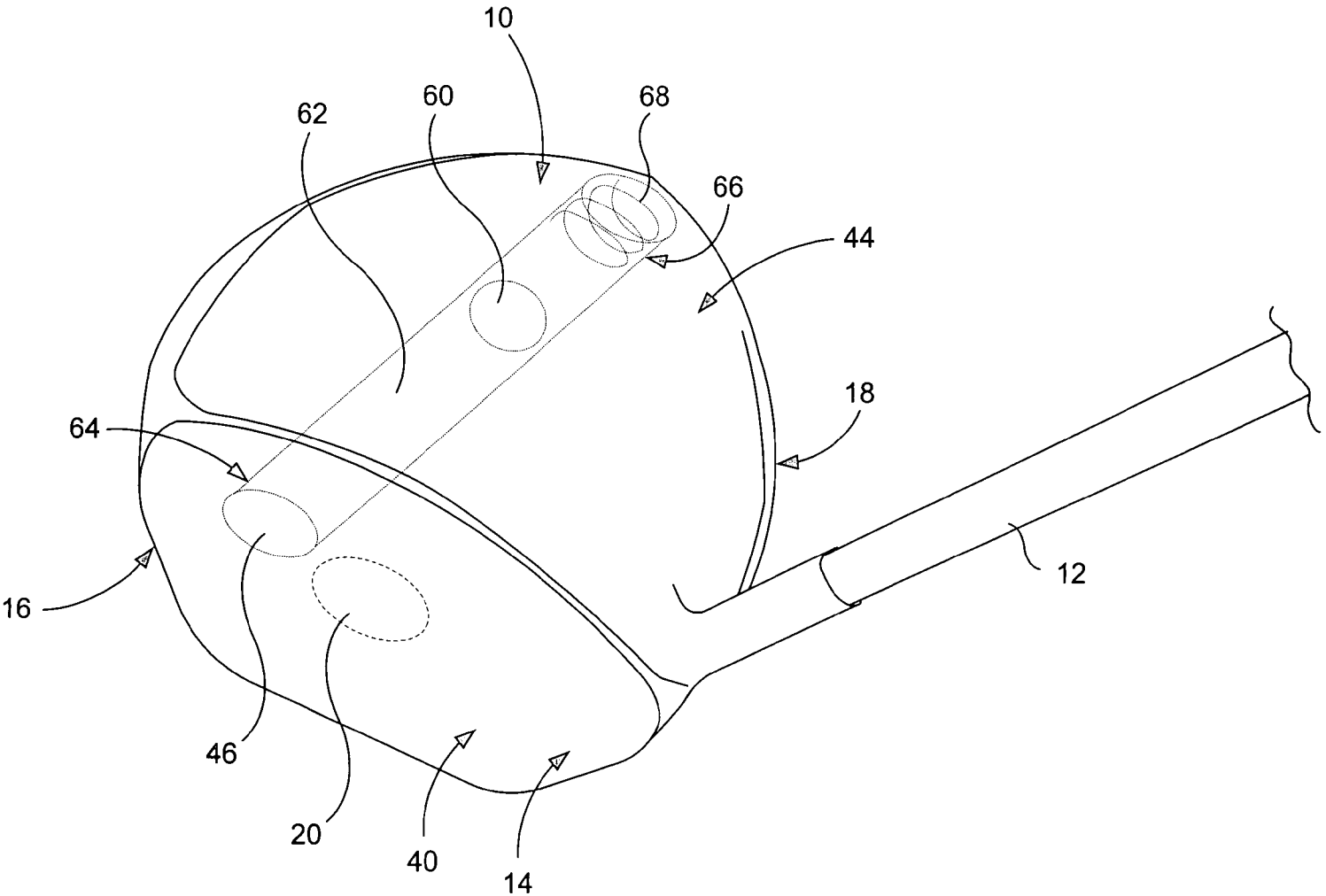
FIG. 8 is a perspective view of an improved golf club head configured according to the attributes of another alternative embodiment of the present invention having an internal impact assembly comprising a ball or ball-like object moveably disposed in a tube or channel that interconnects the backside of the club head with the club face.
Figure 9:
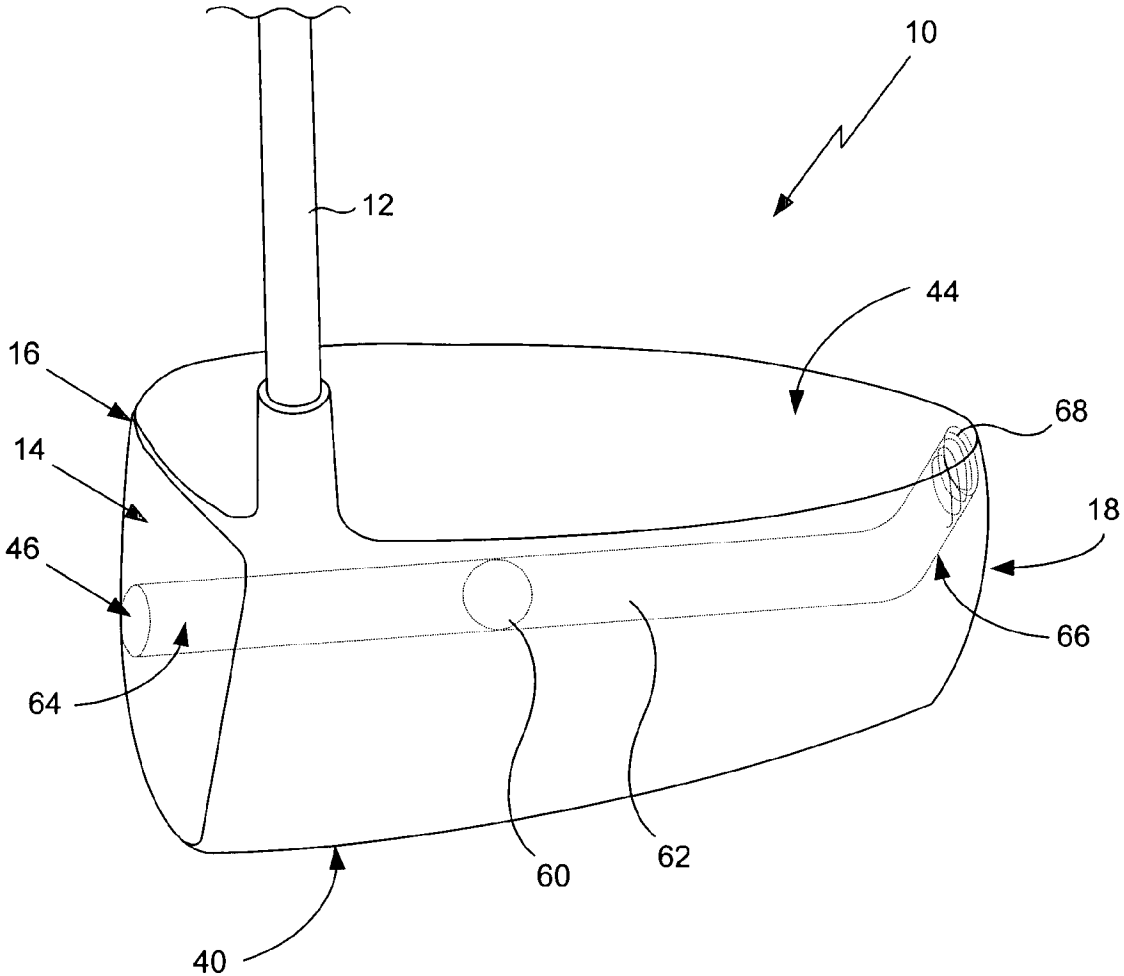
FIG. 9 is a side view of the improved golf club head shown in FIG. 8.
Figure 10:
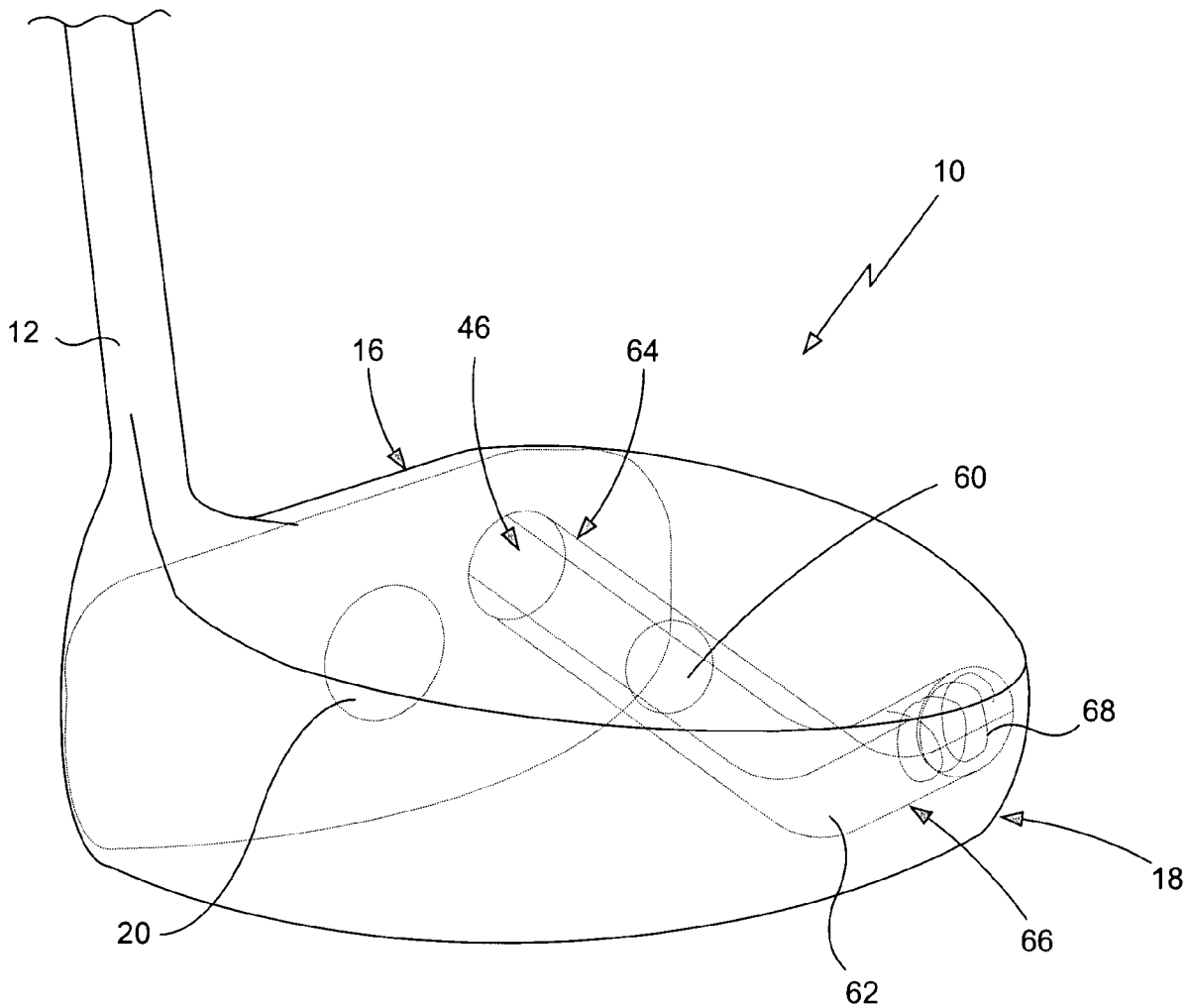
FIG. 10 is a back view of the improved golf club head shown in FIGS. 8 and 9.

In the embodiment of the golf club head 10 of the present invention shown in FIGS. 8 through 10, impact assembly 22 comprises a moveable ball or ball-like object 60 that is disposed in an internal tube 62 located inside golf club head 10. For golf club heads 10 which are solid, the internal tube 62 would be a channel disposed inside the solid club head 10 and configured to be effectively the same as a separate internal tube 62 for club heads 10 having a cavity 19 therein. Ball 60 can be made out of a metal, such as steel, stainless steel, aluminum or the like, plastic, composites or other materials. Tube 62 can also be made out of a variety of different materials, including metals, plastics and various composites. The materials chosen for ball 60 and tube 62 should be selected so that they will cooperatively allow ball 60 to freely roll inside of tube 62 to accomplish the objectives herein, as set forth in more detail below. In the preferred embodiment, ball 60 and tube 62 will be cooperatively sized and configured such that ball 60 freely rolls inside tube 62 without an excessive amount of play or wobble, such that ball 60 will roll directly to impact spot 46 (the impact taking place on the inside or back interior wall 17 of club face 14 where the first end 64 of tube 62, at first end 16 of club head 10, intersects with club face 14). In one configuration, impact spot 46 substantially overlaps with sweet spot 20. In the preferred embodiment of this configuration, impact spot 46 will be located as shown in FIGS. 8 and 10, slightly to the outside of sweet spot 20 so the impact of ball 60 against the interior wall 17 of club face 14 will provide a slight outside force that tends to straighten the travel of the golf ball. Also in the preferred embodiment of this configuration, as shown in FIG. 9, the second end 66 tube 62 (located at second end 18 of club head 10) will be arched or curved slightly upward and be provided with a spring 68 to improve the action/movement of ball 60 during the upswing of the golf club. This slight upturned curvature at the second end 66 is to provide a slight delay in the travel of ball 60 to ensure that it does not arrive at club face 14 before club head 10 strikes the golf ball. To improve the desired movement and impact of ball 60, it is also preferred that tube 62 (which can be a channel in a solid club head 10) is generally arched or angled slightly downward from second end 18 to first end 16 of club head 10, as best shown in FIG. 9.

In use, as the golfer swings the golf club 10 downward towards the golf ball, the ball 60 will be forced back toward second end 66 of tube 62 at the second end 18 of club head 10 against spring 64. When the club face 14 of club head 10 strikes the golf ball, the momentum of ball 60 will cause it to move forward in tube 62 and strike the backside or interior wall 17 of face 14 at impact spot 46. When properly configured, the movement of ball 60 in tube 62 will occur within a fraction of a second after the club face 14 strikes the golf ball, providing a slight outside force or kick to the impact force against the golf ball. Club heads 10 having a club face 14 that is made out of titanium or like "soft" metals will tend to provide more of this extra "kick" from the impact of ball 60. As discussed above, the outside force or kick from impact assembly 22 will counteract the tendency of the golfer's swing to cause a slicing golf ball travel, thereby directing the golf ball in a more straight direction of travel and, in general, causing the golf ball to travel further. As will be recognized by those skilled in the art, placement of impact spot 46 directly at sweet spot 20 will provide additional force to drive the golf ball in the direction of travel from a hit at sweet spot 20 alone. Alternatively, if impact spot 46 is placed on the inside of sweet spot 20 (i.e. opposite side of sweet spot 20 than that shown in FIG. 8), then the impact of ball 60 against the backside of club face 14 will counteract the tendency of the golfer's swing to cause the golf ball to hook.

While there are shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape, and use. For instance, there are components described herein that can be replaced with equivalent functioning components to accomplish the objectives of the present invention. One such modification is the use of different materials than those set forth herein.

What is claimed is:

1. A golf club head having a first end, a second end, a top side, a bottom side and a club face at said first end, said golf club head having a plurality of interior walls defining a cavity therein, said golf club head comprising:

a sweet spot on said club face;

an impact spot on club face; and an impact assembly disposed in said cavity, said impact assembly having a support member, a hammer member and a connecting member interconnecting said support member and said hammer member, said support member comprising a pivot shaft, said support member fixedly attached to or integral with one or more of said interior walls of said cavity, said connecting member pivotally attached to said support member and configured to pivot about said pivot shaft so as to pivot said hammer member against an interior wall of said cavity at said impact spot.

2. The golf club head according to claim 1, wherein said support member has a first end fixedly attached to said bottom side of said club head and a second end fixedly attached to said top side of said club head, said connecting member in a generally cantilever relation with said support member.

3. A golf club head having a first end, a second end, a top side, a bottom side and a club face at said first end, said golf club head having a plurality of interior walls defining a cavity therein, said golf club head comprising:

a sweet spot on said club face;

an impact spot on club face; and an impact assembly disposed in said cavity, said impact assembly having a support member, a hammer member and a connecting member interconnecting said support member and said hammer member, said support member having a first end fixedly attached to said bottom side of said club head and a second end fixedly attached to said top side of said club head, said connecting member in a generally cantilever relation with said support member, said hammer member having a first end and a second end, said connecting member pivotally attached to said support member so as to pivot said first end of said hammer member into contact with said interior wall of said cavity at said impact spot.

4. The golf club head according to claim 3, wherein said support member comprises a pivot shaft, said connecting member configured to pivot about said pivot shaft.

5. The golf club head according to claim 3, wherein said support member, said connecting member and said hammer member of said impact assembly are integrally formed.

* * * * *